United States Patent [19]

Volpe

[11] 4,376,161

[45] Mar. 8, 1983

[54] ENCODER DISC AND METHOD OF MANUFACTURE

[75] Inventor: Luke R. Volpe, Melrose, Mass.

[73] Assignee: Dynamics Research Corporation, Wilmington, Mass.

[21] Appl. No.: 286,987

[22] Filed: Jul. 27, 1981

[51] Int. Cl.[3] ..... C25D 1/08

[52] U.S. Cl. ..... 430/321; 430/315; 430/323; 430/324; 204/11

[58] Field of Search ..... 430/323, 315, 321, 324; 204/11

[56] References Cited

U.S. PATENT DOCUMENTS

| | | | |
|---|---|---|---|
| 3,203,876 | 8/1965 | Deyrup | 204/13 |
| 3,449,221 | 6/1969 | Thomas | 430/323 |
| 3,654,115 | 4/1972 | Langlais | 204/281 X |

FOREIGN PATENT DOCUMENTS

| | | | |
|---|---|---|---|
| 1537243 | 12/1978 | United Kingdom | 204/13 |

*Primary Examiner*—Norman Morgenstern
*Assistant Examiner*—Richard Bueker
*Attorney, Agent, or Firm*—Weingarten, Schurgin, Gagnebin & Hayes

[57] ABSTRACT

An encoder disc is provided with a pattern and a central aperture having a straight uniform interior side wall, with the aperture being precisely located relative to the pattern.

9 Claims, 12 Drawing Figures

ENCODER DISC AND METHOD OF MANUFACTURE

FIELD OF INVENTION

This invention relates to structures which carry patterns for use as position encoders and more particularly to encoding discs and their methods of manufacture.

BACKGROUND OF THE INVENTION

In encoders for measuring rotation, patterns or scales which permit absolute or incremental motion sensing are typically applied to discs which are physically rotated about a central axis to permit electro-optical sensing of motion or position. It will be appreciated that the location of the pattern relative to the central axis requires that a centrally positioned hole or aperture be precisely located with respect to the pattern so that the radial position of the pattern is accurately established regardless of the angular position of the disc on a spindle. Moreover, for precise positioning, the interior side wall or walls of the aperture in the disc must be exceptionally uniform and straight so that when the disc is positioned over a precisely manufactured spindle, the pattern may be accurately referenced to the central rotational axis of the spindle.

In the past, encoder discs or bars have been manufactured, for instance, in accordance with the teachings of U.S. Pat. No. 3,905,817 issued Sept. 16, 1975 to Joseph J. Bakewell. As will be appreciated, in this patent the encoder disc or bars are made from glass and is patterned from a master disc. The finished disc has a plated metal pattern which provides opaque areas, with the rest of the glass encoder disc being light transmissive. Another type of mask is shown in U.S. Pat. No. 3,449,221 issued on June 10, 1969 to Lowell E. Thomas. Additionally, as illustrated in co-pending application Ser. No. 175,444 filed Aug. 4, 1980, by Luke R. Volpe, and assigned to the assignee hereof, an encoder disc or bar is provided with precisely placed reflective and non-reflective segments by providing the non-reflective segment in terms of a roughened or matte surface. This roughened surface is formed in one embodiment by selectively etching a master, with the matte or roughened surface being transferred to an overplated metallic layer when the layer is peeled off, the peelable layer comprising the completed scale. Peelable scales formed in this manner are exceptionally useful because of the ease with which they are manufactured and because of the accuracy with which the pattern on a master platten is transferred to the peelable layer.

When these peelable layers are provided for rotary encoding, it is essential that the patterned layer have a precisely located central aperture. It is also of importance to form the central aperture with a straight side or sides. It should be noted that boring or punching of the center hole can provide non-uniform aperture side walls which can preclude precise positioning of the patterned encoder disc.

SUMMARY OF THE INVENTION

A patterned encoder disc with a precisely positioned straight-walled central aperture is provided by peeling an overplated metallic layer from a flat electrically conductive platten. The platten is first provided with a patterned photoresist and a precisely located protruding non-conductive plug, the outer surface of which defines straight side walls for the aperture of the peelable layer.

When the peelable layer is electroformed over the platten, the plug removed, and the electroformed layer peeled from the platten, the central aperture in the resulting encoder disc takes on the configuration defined by the outer wall or walls of the non-conductive plug. Since the plug can be machined to exceptionally good accuracy, the interior wall of the resulting encoder disc aperture is likewise accurate, uniform and straight.

The precise locating of the non-conductive plug with respect to the pattern is provided by providing a transparent master disc with a patterned layer of opaque material. In one embodiment the master disc is provided with radially located transparent pattern portions and an extremely precisely located permanent central spindle. In the usual case the spindle is cylindrical, although any regular configuration is within the scope of this invention. Thus, the spindle may have a polygonal or splined cross-section.

In the manufacturing process, the master platten is first provided with a layer of photoresist. An aperture or hole having a configuration corresponding to that of the spindle is then provided through the photoresist layer and the platten. The master disc with spindle projecting downwardly is positioned over the photoresist layer on the master platten, with the permanent spindle protruding into the hole or aperture in the platten. Thereafter, the photoresist is exposed and the master disc is removed. The photoresist is then developed, leaving a photoresist pattern on the master platten which corresponds to that of the master disc. It will be appreciated that the photoresist pattern is as precisely located with respect to the central hole or aperture as was the pattern on the master disc with respect to its permanently located spindle. Depending on the type of encoder disc desired, the pattern of the master disc is either as described above or the reverse, in which the radially extending patterns are opaque instead of transparent.

For peelable encoder discs which are to be provided with patterned apertures, the pattern left by the developing of the photoresist corresponds in configuration to the transparent portions of the master disc. Photoresist is also left in all areas outside the perimeter defined by the outer edge of the master disc. A non-conductive protruding plug is positioned in the aperture or hole and the top portion of the platten is metalized with, in one embodiment, an electroformed nickel layer. Thereafter, the non-conductive plug is removed and the layer is stripped from the master platten. The resultant disc thus has precisely positioned apertures corresponding to the pattern on the master disc, with a central aperture or hole being precisely located with respect to the patterned apertures. Moreover, the central hole or aperture in the completed encoder disc is provided with a straight side or sides so that when the disc is mounted to a corresponding spindle, the radial position of the patterned apertures will be exceptionally precise with respect to the central rotational axis of the spindle.

When a peelable encoder disc is to be provided with patterned reflective and non-reflective segments, a highly polished master platten is provided and a reverse type master disc is utilized such that when the photoresist is developed, there will be apertures in the photoresist layer corresponding to the opaque radially extending pattern. It will be appreciated that the apertures expose the highly polished top surface of the master platten. An etchant is directed over the top surface of the resulting structure so as to provide the master platten with a roughened or matte finish in a manner similar to that described in the aforementioned patent application. After the etching step, the photoresist is removed which leaves a roughened pattern on the highly polished top surface of the platten. Thereafter, a non-conductive plug of the type described above is provided along with a non-conductive annular ring which encircles the patterned area on the platten so as to define the perimeter of the finished disc. The area encircled by the ring is then provided with an electroformed layer. When this layer is peeled from the surface of the platten, an encoder disc is provided with a roughened patterned area precisely located with respect to a straight-walled central hole or aperture. The precision of the location of the pattern with respect to the central aperture is the same as in the aforementioned embodiment.

In an alternative embodiment, the permanent master disc spindle is cylindrical, as is the aperture in the platten. However, the protruding portion of the plug may be given any predetermined configuration, e.g. square, hexagonal, or may be provided with a radially extending groove which can form a keyway for the finished encoder disc. Thus, the plug may have a cylindrical shaft adapted to fit into the platten aperture and can be provided with a differently configured protruding portion.

In summary, peelable encoder discs are provided with patterns which are precisely located with respect to a straight-walled central aperture.

BRIEF DESCRIPTION OF THE DRAWINGS

These and other features of the subject invention will be better understood in connection with the following detailed description taken in conjunction with the drawings of which.

DETAILED DESCRIPTION

Figure 1A:
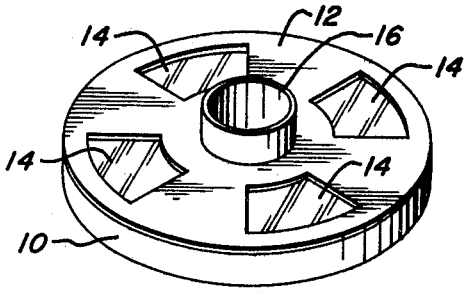
FIGS. 1A–1E illustrate respectively, the master disc with permanent spindle, the location of the master disc over a master platten having a photoresist layer and an aperture therethrough, the resulting patterned photoresist on top of the platten also indicating the utilization of the non-conductive plug, the platten with electroformed layer, and the resulting electroformed disc peeled from the platten; and, FIGS. 2A–2G illustrate respectively, a reverse pattern master disc with permanently located center spindle, the placement of the master disc over a master platten having an overlayer of photoresist and an aperture therethrough, the resulting patterned photoresist after development of the photoresist, the roughened surface pattern on the top surface of the master platten after etching and removal of the photoresist, the positioning of a non-conductive plug and annular ring on the platten, the result of electroforming a layer within the confines of the annular ring, and the resulting electroformed disc peeled from the platten.

Referring now to FIGS. 1A–1E, a manufacturing process is depicted for the provision of an apertured encoder disc with a precisely located straight-walled central hole or aperture. In FIG. 1A, a master disc 10 is provided which is transparent, and in one embodiment is made of glass. Over top of disc 10 is provided a patterned layer 12 of opaque material which, in one embodiment, is either a chrome or Inconel layer which has been precisely photo patterned and vacuum deposited on the top surface of disc 10. The result of the application of the opaque patterned layer is that a patterned structure of opaque and transparent portions is provided on a surface of the disc which is to lie immediately adjacent to a photoresist layer when the disc is inverted and positioned over the photoresist. In the embodiment illustrated in FIG. 1A, the patterning provides transparent pattern portions 14 which are precisely radially located with respect to the center of the disc. The patterned disc is provided with a precisely located central bore into which is positioned a permanent central spindle 16 which, in one embodiment, is made of stainless steel.

Figure 1B:
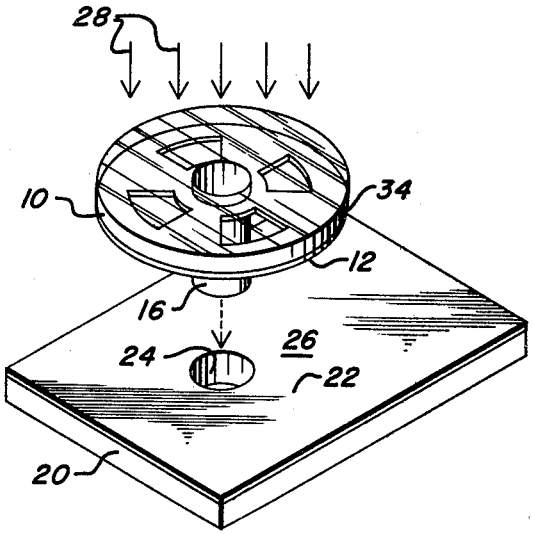

Referring to FIG. 1B, disc 10 is inverted such that spindle 16 projects downwardly. This structure is positioned over an electrically conductive master platten 20 made of stainless steel, which is provided with an overlying photoresist layer 22 through which has been provided an aperture or hole 24 which corresponds in inside diameter to the outside diameter of spindle 16. In the embodiment illustrated in FIGS. 1A–1E, the photoresist layer is of a negative type and in general, is type Laminar AX manufactured by Dynachem of California.

With master disc 10 in place, the top surface 26 of the photoresist is exposed, in one embodiment through the utilization of ultra-violet light generally indicated by arrows 28, so as to provide hardened areas in those portions which are exposed to the ultra-violet light. Thereafter the master disc is removed.

Figure 1C:
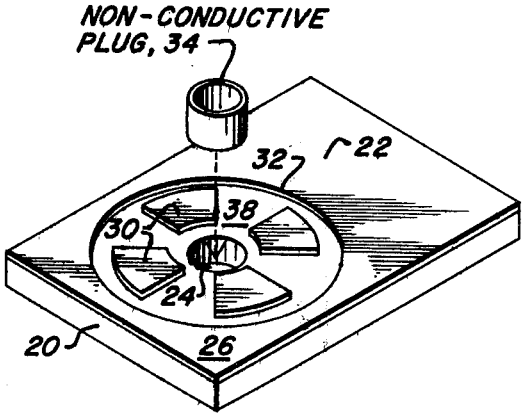

Referring to FIG. 1C, the resulting patterned layer 22, after development, provides correspondingly patterned areas 30 radially located with respect to aperture 24 and a perimeter 32 which is defined by the outer wall 34 of disc 10. This perimeter defines the outer edge of the encoder disc to be provided by follow-on electroforming steps.

A non-conductive plug 34 is then inserted into aperture 24 with the inside diameter of aperture 24 corresponding to the outside diameter of plug 34. The non-conductive plug may be made of polytrifluoroethylene and is machined to have an exceedingly straight and smooth outer wall. The plug is of a length such that a portion thereof extends above the plane defined by surface 26 and a layer of electrically conductive material is electroformed over the exposed top surface of the platten here illustrated at 38.

Figure 1D:
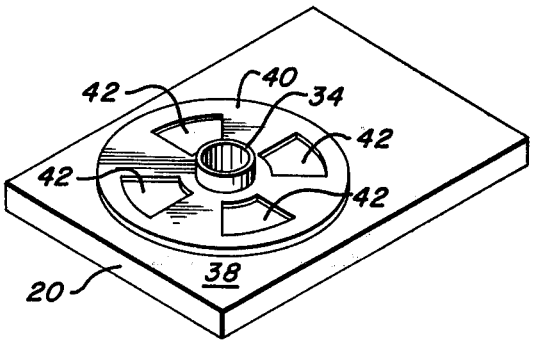
Figure 1E:
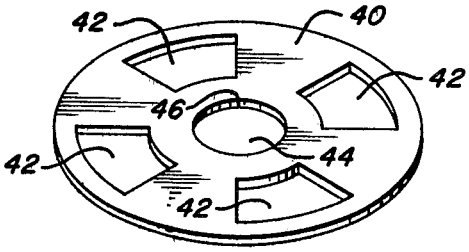

Referring to FIG. 1D, after removal of the remaining photoresist, a disc 40 of electroformed material remains, having radially extending apertures 42 resulting from the removal of the photoresist. Plug 34 is then removed and the remaining disc stripped or peeled from top surface 38 of platten 20, which resultant disc is illustrated in FIG. 1E. As illustrated, apertures 42 are precisely located with respect to a central aperture 44 in disc 40. Moreover, the inner wall 46 of disc 40 is provided with a straightness and uniformity determined by the straightness and uniformity of the outer wall of the non-conductive plug. Thus, what has been provided is an apertured encoder disc in which the apertures are exceedingly, precisely located with respect to the center of the disc and in which a central aperture is provided having exceedingly straight uniform interior wall.

Referring to FIGS. 2A–2G, a method of manufacture is illustrated for providing an encoder disc with patterned roughened areas adjacent exceedingly smooth reflective areas. The rough, smooth pattern on the encoder disc provides the code for the encoder disc in terms of the reflectance or lack thereof for the various patterned areas of the disc.

Figure 2A:
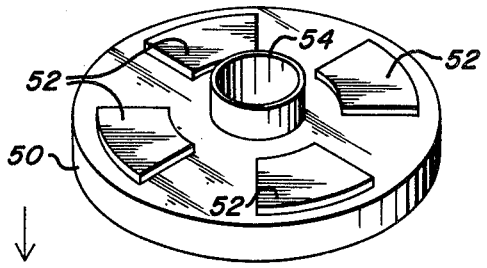
Figure 2B:
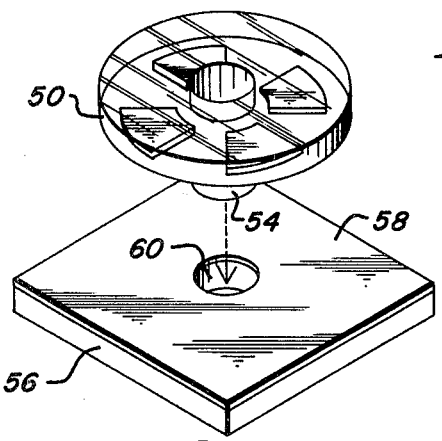
Figure 2C:
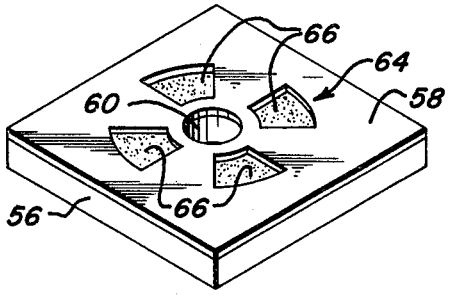
Figure 2D:
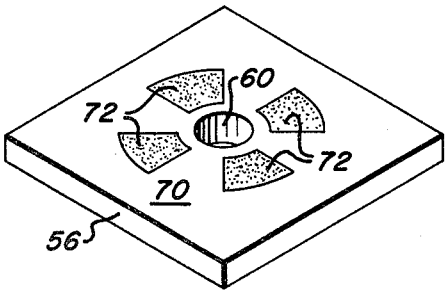

Referring to FIG. 2A, a master disc 50 is provided which, in the embodiment shown, is likewise transparent and made of glass. A patterned opaque layer illustrated by portions 52, is provided on a surface of the transparent disc which pattern is a reverse of the pattern of the disc illustrated in FIG. 1A. A permanent centrally located stainless steel spindle 54 is provided as illustrated and disc 50, as illustrated in FIG. 2B, is positioned over a master platten 56 which is provided with a negative photoresist layer 58. Here, a downwardly projecting spindle 54 projects into aperture 60 which is provided through photoresist layer 58 and platten 56. Upon exposure with ultra-violet light as illustrated at 62, and after removal of master disc 50, the result is a patterned photoresist structure generally indicated at 64 in FIG. 2C. In this figure, apertures 66 correspond in position to opaque portions 52, with the remaining photoresist layer 58 having been hardened by virtue of the exposure. In this embodiment, the negative photoresist is of a wet or dry film variety which is resistant to an etchant such as ferric cloride ($FeCl_3$). Here the master platten 56 is electrically conductive and made of stainless steel. With etchant introduced into apertures 66, the result, as illustrated in FIG. 2D is a highly polished master platten surface 70 provided with patterned roughened areas 72 which have been provided with a matte finish and are precisely radially located with respect to aperture 60.

It will be appreciated that the inner diameter of aperture 60 matches the outer diameter of spindle 54 as was the case in the previously described embodiment.

Figure 2E:
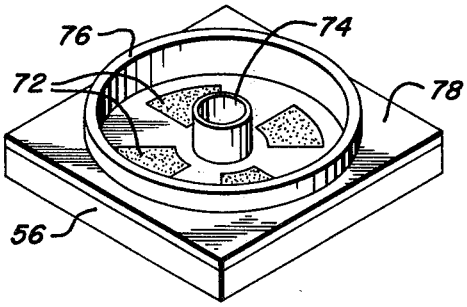

Referring to FIG. 2E, a non-conductive plug 74 is positioned in aperture 60 with the outer walls of non-conductive plugs 74 being straight and having an outside diameter corresponding to the inside diameter of aperture 60. Additionally, an annular ring 76 of non-conductive material such as polytrifluoroethylene is provided to encircle patterned areas 72, which ring defines the periphery of the finished disc. Thereafter, a vulcanized silicone rubber layer 78 is provided exteriorally of annular ring 76, which rubberized material may be provided in any convenient fashion and is manufactured as RTV by the General Electric Company.

Figure 2F:
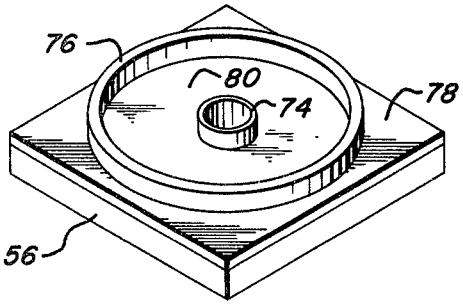

As illustrated in FIG. 2F, a disc 80 is electroformed within the confines of ring 76 in a conventional manner. After the electroforming process the non-conductive plug is removed, the ring is removed and disc 80 is stripped from the platten.

Figure 2G:
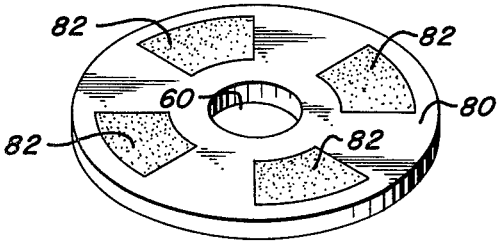

The resulting disc is as illustrated in FIG. 2G in which patterned areas 82 are provided on the surface of the disc, which areas are provided with the same matte finish as that provided on the top surface of the platten. The patterned areas on the disc are thus non-reflective whereas the remainder of the disc is reflective. The radial positions of the pattern are precisely located with respect to the center of the disc and aperture 84 is provided with exceptionally straight interior wall due, again, to the utilization of the protruding non-conductive plug.

If desired, the central aperture in an encoder disc may be provided with something other than a cylindrical configuration. This may be accomplished, in one embodiment, by providing a non-conductive plug with a cylindrical shaft adapted to be positioned in the aperture in the platten. The protruding portion of the plug may be provided with any desired configuration such that the resulting aperture in the encoder disc takes on this configuration. Thus, the aperture in the encoder disc may be given a polygonal configuration or may be provided with the aforementioned keyway.

In summary, the process for manufacturing the encoder disc includes providing a transparent master disc with appropriately patterned opaque regions and a precisely located central spindle. A master platten is provided with a layer of photoresist and an aperture configured to receive the spindle of the master disc in a tight fit is provided through the resist and platten. The master disc is then positioned over master platten with the spindle in the aperture, and the photoresist is exposed and developed. A non-conductive plug having a uniform straight outer wall or walls is positioned in the aperture in the master platten so as to protrude above the top surface of the photoresist and, in one embodiment, the exposed portions of the master platten are overplated with a metallic layer in an electroforming step. When the metallic layer is stripped from the master platten it contains apertures in accordance with the patterned photoresist and a precisely located central aperture having a uniform straight interior wall or walls defined by the outer wall of the non-conductive plug. In another embodiment the top surface of the platten is polished prior to providing the photoresist, and a reverse pattern is provided on the master disc. After exposure and development of the photoresist and prior to electroforming, the top surface of the master platten is subjected to an etchant which produces a matte finish at the portions of the surface of the master platten exposed through the patterned photoresist. With a non-conductive protruding plug having a uniform straight outer wall in place and all photoresist removed, a non-conductive ring is positioned around the patterned area to define the outer edge of a finished disc. Thereafter, a metallic layer is overplated within the confines of the ring and is then stripped from the master platten such that the finish disc has roughened areas corresponding to the etched areas on the master platten. The stripped disc also includes a precisely located central aperture with a uniform straight interior wall or walls defined by the outer wall of the non-conductive plug.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A method of making an encoder disc comprising the steps of:

positioning a transparent master disc having an opaque pattern thereon and a central spindle over an electrically conductive master platten having a photoresist layer thereon and an aperture through the photoresist layer and the platten, such that the spindle protrudes into the aperture;

exposing the photoresist through the master disc;

removing the master disc;

developing the photoresist;

locating a non-conductive straight-sided plug in the aperture;

electroforming a layer over the platten; and, stripping the electroformed layer from the platten.

2. The method of claim 1 wherein said central spindle is permanently mounted to said master disc.

3. The method of claim 1 wherein the surface of the platten over which the master disc is positioned is highly polished, and further including prior to the plug locating step, the steps of:

etching the portions of the polished surface of the platten exposed after the developing step;

removing the photoresist remaining after the etching step; and, providing a non-conductive ring on the platten about the etched regions on the platten.

4. The method of claim 1 wherein the opaque pattern is on the same side of the master disc as that from which the central spindle projects, whereby when the master disc is positioned over the master platten, the opaque pattern is in intimate contact with the photoresist layer.

5. The method of claim 1 wherein the photoresist layer includes a negative photoresist.

6. The method of claim 1 wherein the spindle has an outside diameter corresponding to the inside diameter of the aperture through the photoresist layer and the platten.

7. The method of claim 1 wherein the spindle is cylindrical.

8. The method of claim 1 wherein the spindle includes a notch.

9. The method of claim 1 wherein the spindle is polygonal.

* * * * *